United States Patent [19]

Cagnioncle

[11] 4,358,227

[45] Nov. 9, 1982

[54] DEVICE FOR PREPARING AND INJECTING SEALING CHARGES OF CEMENT

[75] Inventor: George Cagnioncle, Lyons, France

[73] Assignee: Société Chimique des Charbonnages SA, Paris La Défense, France

[21] Appl. No.: 155,236

[22] Filed: Jun. 2, 1980

[30] Foreign Application Priority Data

Jun. 1, 1979 [FR] France ..... 79 14082

[51] Int. Cl.[3] ..... B05B 7/06

[52] U.S. Cl. ..... 406/96; 222/145; 222/214; 222/372; 222/630; 406/46

[58] Field of Search ..... 417/394, 900; 222/145, 222/214, 372, 373; 406/48, 96, 630; 239/424

[56] References Cited

U.S. PATENT DOCUMENTS

| | | | |
|---|---|---|---|
| 991,814 | 5/1911 | Akeley | 406/48 X |
| 2,829,600 | 4/1958 | Sveda | 417/900 X |
| 3,304,126 | 2/1967 | Rupp et al. | 406/96 |
| 3,434,808 | 3/1969 | Pobst, Jr. | 406/96 X |
| 3,712,681 | 1/1973 | Marino et al. | 406/48 |
| 4,116,368 | 9/1978 | Smith | 222/145 |

FOREIGN PATENT DOCUMENTS

| | | | |
|---|---|---|---|
| 1081818 | 5/1960 | Fed. Rep. of Germany | 222/214 |
| 2316481 | 10/1973 | Fed. Rep. of Germany | 222/214 |
| 2410212 | 9/1975 | Fed. Rep. of Germany . | |
| 918016 | 1/1947 | France . | |
| 1334848 | 4/1962 | France . | |
| 1524640 | 5/1968 | France . | |
| 2208313 | 6/1974 | France . | |
| 2384549 | 10/1978 | France . | |
| 227336 | 4/1924 | United Kingdom | 406/48 |

*Primary Examiner*—David A. Scherbel
*Attorney, Agent, or Firm*—Millen & White

[57] ABSTRACT

The invention relates to a device for the preparation and injection of sealing cement for bolts in propping gallery roofs and walls in mines, quarries or tunnels. The device of the invention comprises a flexible pouch contained in a rigid housing which is connected to a liquid supply system and an injection nozzle that is double-walled along its entire length, the inner nozzle receiving pulverulent cement from the flexible pouch and the outer ring of the nozzle being supplied with water. Thus, the cement and water are separately introduced into a bore for the bolts and the mixing process takes place in the bore.

8 Claims, 2 Drawing Figures

DEVICE FOR PREPARING AND INJECTING SEALING CHARGES OF CEMENT

BACKGROUND OF THE INVENTION

In mining, gallery roof and wall propping is being increasingly done by using the so-called "bolting method" in preference to the more classical method involving wood or steel bracing. Under the bolting method, steel rods or bolts are anchored in holes that have been bored to a diameter of 20 to 60 mm.

The rods or bolts can be anchored or sealed by one of the three following methods: (1) the so-called mechanical method, which uses a steel rod fitted with shells or plates which are expanded like an umbrella by means of wedges or by screwing, (2) the resin cartridge method and (3) the method in which resin or cement in bulk is forced into the bore as a sealing charge for a bolt.

When the bolts are sealed in with cement, preparing and inserting the charge into the prepared boring is a long and delicate operation. In addition, cements containing accelerators have very short working times once mixed with water, which makes the preparation and injection even more delicate.

SUMMARY OF THE INVENTION

In an article of manufacture aspect, this invention provides a device for the preparation and injection of sealing cement for bolts in propping gallery roofs and walls which comprises a flexible pouch contained in a rigid housing which is connected to a fluid supply system, and a double-walled injection nozzle, the inner tube of the nozzle receiving pulverulent cement from the flexible pouch and the outer ring of the nozzle being supplied with water.

DETAILED DISCUSSION

The size of the pouch is designed to correspond to the amount of sealing cement required to seal one bolt which in practice comes out to 100 to 300 grams. The housing is connected to a fluid supply system enabling the introduction of liquid between the rigid housing and the flexible pouch. The liquid can be water, oil or any non-corrosive liquid. The flexible pouch is supplied with dry powder cement by a pneumatic system. The flexible pouch is also connected to the inner tube of the double-walled nozzle through a flexible tube made out of resilient material. The injection nozzle is made of two concentric tubes made out of glass or preferably of steel.

The device operates as follows. Cement is introduced into the flexible pouch. Then fluid is supplied to the rigid housing, thus compressing the flexible pouch and expelling cement out of the pouch through the nozzle and out of the nozzle into the bore hole. At the same time water is fed into the outer ring of the nozzle. Thus at the opening of the nozzle in the bore, water and cement get mixed.

This device is particularly useful in conjunction with automatic bolting systems for it allows the dry cement to be wetted directly in the prepared boring, with the injection nozzle penetrating as a third or a half of the hole depth.

This device has the advantage of enabling precise dosing of product quantity in accordance with rod or hole characteristics. Thus, for example, it takes no more than changing the pouch or injecting its contents several times to change the amount of sealing cement being injected.

The device also allows hardening accelerators to be added to either the dry cement or to the water.

DESCRIPTION OF THE DRAWINGS

The characteristics of the invention can be seen more clearly in the annexed figures.

DETAILED DISCUSSION OF THE INVENTION

Figure 1:
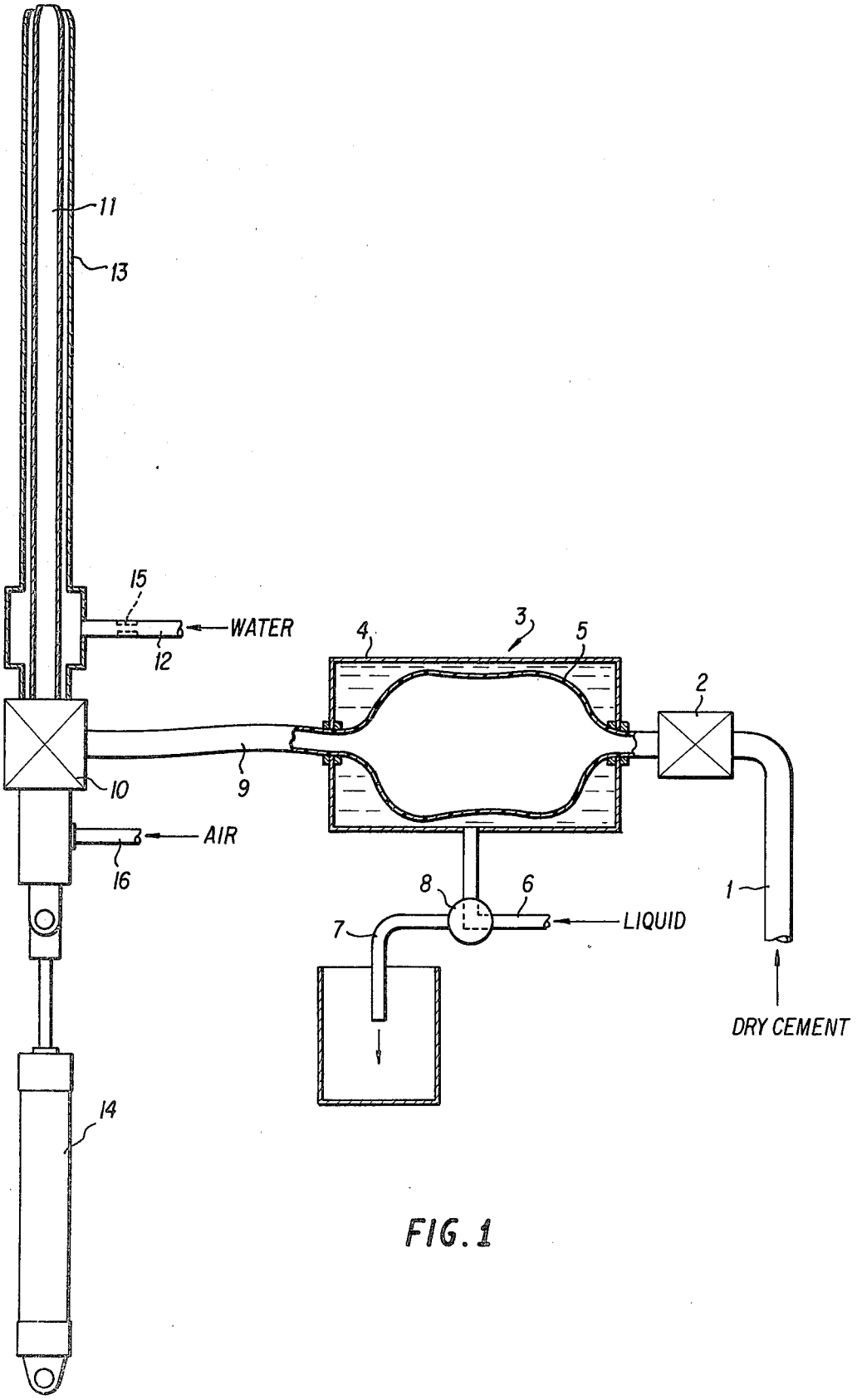
FIG. 1 shows a cross-section of the device

Dry cement is supplied pneumatically through inlet (1), valve (2) on inlet (1) feeds the dry powder cement into a dosing unit (3). The dosing unit is composed of a rigid housing (4) and of a pouch or bag (5) made of flexible material. A fluid such as water or oil is supplied through inlet (6) between the housing (4) and the pouch (5) and drained through outlet (7). A three-way valve (8) connects the fluid supply inlet (6) and drainage outlet (7) to the rigid housing. Tube (9) feeds the dry cement through a three-way valve (10) to the inner tube of an injection nozzle (11) having a second outer concentric ring of the nozzle (13) which can be inserted into the bore.

The water circuit consists of a hose (12) equipped with a calibrating device (15) and by the outer concentric ring between nozzles (11) and (13). The water is generally supplied at a pressure of 6 to 15 bars. Calibration device (15) is a standard type of fluid flowrate regulation device such as a diaphragm or a perforated plate that can be changed to increase or decrease the fluid flowrate.

Figure 2:
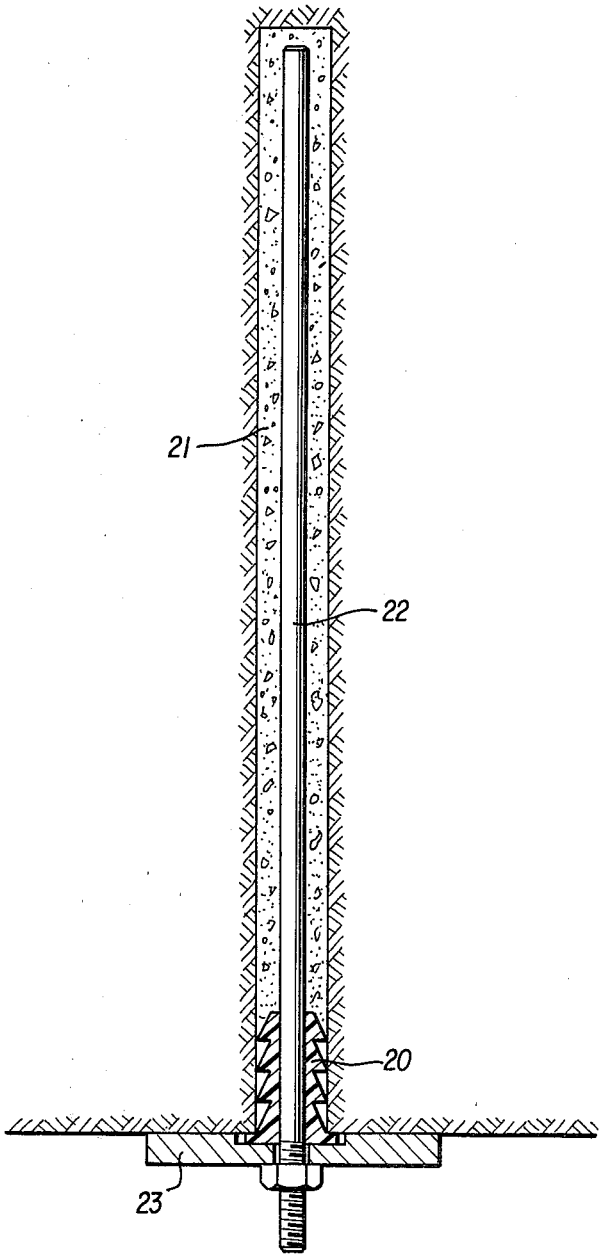
FIG. 2 shows a cross-section of the bore with the rod to be sealed in position.

A jack (14) serves to move the nozzle in the bore for the bolt to be sealed, as can be seen by arrow (21) in FIG. 2.

Inlet (16) located in the injection nozzle upstream from the cement flowing through three-way valve (10) serves to inject air through that valve. Air can be blown through the injection nozzle to clean it out in case of prolonged stoppage of the device. This prevents the cement and its additives from hardening in the nozzle. Compressed air, e.g at 5 bars and at a flowrate on the order of 300 to 400 liters/minute, is used for this purpose. How long the air should be injected is calculated by the operator according to the time it takes for the cement to harden.

The device operates as follows. Cement inlet valve (2) is opened and valve (8) is switched to outlet (7). In the meantime valve (10) is closed off to tube (9) and inlet (16). The dry cement under compressed air pressure fills pouch (5), following which valve (2) is closed and valve (10) is turned to connect tube (9) to nozzle (11), and valve (8) is turned to connect fluid inlet (6) to rigid housing (4). This drives cement through nozzle (11). At the same time, water is fed into the outer ring of the nozzle through calibration device (15), which serves to control the quantity of water. The device uses preferably a standard calibration system such as a perforated diaphragm.

FIG. 2 shows a bore hole (21) into which cement and water have been injected. The bolt to be sealed (22) has been inserted with a rotary motion in order to complete the mixing of the sealing ingredients, and it is held in place until hardening, by a plastic plug (20) under bearing plate (23).

I claim:

1. A device for preparing and injecting sealing charges directly into a borehole for sealing bolts emplaced therein, comprising:

(a) cement means for supplying powdered dry cement under compressed air pressure;

(b) a rigid housing having a flexible pouch located therein, and said flexible pouch adapted for being placed in communication with said cement supply means for receiving a predetermined dose of powdered dry cement;

(c) fluid supply means operatively associated with said rigid housing for intermittently introducing a fluid into said rigid housing between the inside of said rigid housing and said flexible pouch;

(d) a double wall injection nozzle having an inner tube adapted to communicate with said flexible pouch for having powdered dry cement flow therethrough; and a concentrically arranged outer tube with the outlet end arranged so as to terminate at the same location relative to the outlet end of said inner tube; and (e) water supply means adapted to communicate with said outer tube for supplying water therethrough.

2. A device as in claim 1, further comprising air injection means connected to said double wall injection nozzle upstream from said water supply means and said flexible pouch for blowing air through said nozzle for cleaning said nozzle out during prolonged non-operating periods of the device.

3. A device as in claim 1, further comprising cement supply valve means connecting said flexible pouch to said cement supply means for controlling the flow of powdered dry cement into said flexible pouch.

4. A device as in claim 1, further comprising fluid valve means for controlling the fluid flow into and out of said rigid housing.

5. A device as in claim 1, further comprising: water supply valve means for controlling the flow of water into said outer tube; and water flow regulating means for limiting the rate of flow of water flowing into said outer tube.

6. A device as in claim 1, further comprising cement flow valve means for controlling the flow of cement from said flexible pouch into said inner nozzle.

7. A device for preparing and injecting sealing charges directly into a borehole for sealing bolts emplaced therein, comprising:

(a) cement supply means for supplying powdered dry cement under compressed air pressure;

(b) a rigid housing having a flexible pouch located therein, and said flexible pouch adapted for intermittently being placed in communication with said cement supply means for receiving a predetermined dose of powdered dry cement;

(c) fluid supply means operatively associated with said rigid housing for intermittently introducing a fluid into said rigid housing between the inside of said rigid housing and said flexible pouch;

(d) a double wall injection nozzle having an inner tube adapted for intermittently being placed in communication with said flexible pouch for having powdered dry cement flow therethrough and a concentrically arrranged outer tube; and (e) water supply means adapted to intermittently communicate with said outer tube for supplying water therethrough, whereby said cement supply means serve to fill said flexible pouch with powdered dry cement thereby expanding the walls thereof, and subsequently said fluid supply means introduces a fluid into said rigid housing exerting a pressure on said flexible pouch to cause the powdered dry cement to flow therefrom into said inner tube of said nozzle and simultaneously water is injected into said outer tube so that water and powdered dry cement separately flow from said injection nozzle into a borehole to be mixed therein.

8. A method of preparing and injecting sealing charges directly into a borehole for sealing bolts emplaced therein, comprising:

flowing dry powdered cement under compressed air pressure into a flexible pouch to fill said pouch to a predetermined dose amount and thereby causing said pouch to expand;

subsequently flowing a fluid against the outer wall of said flexible pouch to exert a pressure thereon and thereby cause the dry powdered cement to flow therefrom into a double wall nozzle to be injected through an inner one of two concentric tubes of said nozzle; and injecting water, simultaneously to said flowing of said fluid, into the outer one of the two concentric tubes of the double wall nozzle whereby the water and cement are independently and simultaneously injected from said nozzle and into said borehole from said double wall nozzle and thereby mix in said borehole upon leaving the nozzle.

* * * * *